US008629779B2

(12) United States Patent
Aebersold et al.

(10) Patent No.: US 8,629,779 B2
(45) Date of Patent: Jan. 14, 2014

(54) ADAPTING A SCANNING POINT OF A SAMPLE AND HOLD CIRCUIT OF AN OPTICAL SMOKE DETECTOR

(75) Inventors: Hans Aebersold, Bonstetten (CH); Berni Imfeld, Uster (CH); Wolf Liebert, Kirchdorf (CH)

(73) Assignee: Siemens Aktiengesellschaft, Munich (DE)

( * ) Notice: Subject to any disclaimer, the term of this patent is extended or adjusted under 35 U.S.C. 154(b) by 377 days.

(21) Appl. No.: 13/128,672

(22) PCT Filed: Nov. 11, 2008

(86) PCT No.: PCT/EP2008/065324

§ 371 (c)(1),
(2), (4) Date: Jun. 29, 2011

(87) PCT Pub. No.: WO2010/054682

PCT Pub. Date: May 20, 2010

(65) Prior Publication Data

US 2011/0255091 A1 Oct. 20, 2011

(51) Int. Cl.
*G08B 17/10* (2006.01)

(52) U.S. Cl.
USPC ..... 340/630; 340/628

(58) Field of Classification Search
USPC ..... 340/628, 630
See application file for complete search history.

(56) References Cited

U.S. PATENT DOCUMENTS

| | | | | |
|---|---|---|---|---|
| 5,530,433 | A | 6/1996 | Morita | |
| 5,705,988 | A * | 1/1998 | McMaster | 340/628 |
| 2003/0001746 | A1 * | 1/2003 | Bernal et al. | 340/630 |

FOREIGN PATENT DOCUMENTS

| | | | |
|---|---|---|---|
| CN | 1077810 | A | 1/2002 |
| EP | 0 618 555 | A2 | 10/1994 |
| GB | 2 158 627 | A | 11/1985 |
| RU | 2256230 | C2 | 7/2005 |
| SU | 1243006 | A1 | 7/1986 |

* cited by examiner

*Primary Examiner* — Travis Hunnings
(74) *Attorney, Agent, or Firm* — Laurence A. Greenberg; Werner H. Stemer; Ralph E. Locher

(57) ABSTRACT

A smoke detector contains a radiation source for transmitting an illuminating radiation having a time sequence of radiation pulses, a radiation detector for receiving measurement radiation impinging on the radiation detector after at least partial scattering of the illuminating radiation, an amplifier circuit for amplifying an output signal of the radiation detector, an analog to digital converter having a sample and hold circuit for converting an analog output signal of the amplifier circuit into a digital measurement value, and a control device coupled to the radiation source and the sample and hold circuit. The control device is equipped for controlling the radiation source and the sample and hold circuit such that the time of a sampling point in time of the sample and hold circuit relative to a radiation pulse depends on the duration of the radiation pulse. A method for calibrating the described smoke detector is also revealed.

9 Claims, 3 Drawing Sheets

ADAPTING A SCANNING POINT OF A SAMPLE AND HOLD CIRCUIT OF AN OPTICAL SMOKE DETECTOR

BACKGROUND OF THE INVENTION

Field of the Invention

The present invention relates to the technical field of smoke alarm systems. The present invention relates in particular to the signal processing of a device for detecting smoke on the basis of measurements of scattered electromagnetic radiation. The present invention also relates to a method for calibrating a device for detecting smoke on the basis of measurements of scattered electromagnetic radiation.

Optical or rather photoelectric smoke alarms generally employ the well-known scattered-light method, making use of the fact that clear air reflects virtually no light. However, if smoke particles are present in a measuring chamber, illuminating light emitted by a light source is at least partially scattered by the smoke particles. Part of this scattered light is then incident on a light detector which is not directly impinged by the illuminating light. In the absence of smoke particles in the measuring chamber, the illuminating light cannot reach the light detector.

The light detector of an optical smoke alarm is typically a photodiode which only produces a very small measurement signal. The photodiode is therefore followed by an electronic amplifier circuit which converts a current provided by the photodiode into a voltage and amplifies this voltage such that the signal can undergo further processing in a downstream system. The downstream system comprises, for example, an analog-to-digital converter and a microcontroller for additional signal processing.

Amplifier circuits of photodiodes in optical smoke detectors mainly use operational amplifiers which are also incorporated in specific ASIC (Application Specific Integrated Circuit) devices and/or microcontrollers. These adversely affect the material costs and power consumption for the amplifier circuit and therefore for the optical smoke detector as a whole.

BRIEF SUMMARY OF THE INVENTION

In device terms, the object of the invention is to create a smoke detector based on the scattered radiation principle which can be manufactured inexpensively and also has a low power consumption. In method terms, the object of the invention is to specify a calibration method for a smoke detector based on the scattered radiation principle.

This object is achieved by the subject matters of the independent claims. Advantageous embodiments of the present invention are described in the dependent claims.

According to a first aspect of the invention, a device for detecting smoke on the basis of measurements of scattered electromagnetic radiation is described. The smoke detection device described has (a) a radiation source for emitting illuminating radiation comprising a time sequence of radiation pulses, (b) a radiation detector for receiving measuring radiation incident on the radiation detector after at least partial scattering of the illuminating radiation, (c) an amplifier circuit for amplifying an output signal of the radiation detector, (d) an analog-to-digital converter with a sample and hold circuit for converting an analog output signal of the amplifier circuit into a digital measured value, and (e) a control device linked to the radiation source and the sample and hold circuit. According to the invention, the control device controls the radiation source and the sample and hold circuit such that the position in time of a scanning timepoint of the sample and hold circuit relative to a radiation pulse depends on the duration of the radiation pulse.

The smoke detector described is based on the recognition that a time shift of the analog output signal of the amplifier circuit relative to a radiation pulse of the radiation source, resulting from a variation in the pulse duration of the illuminating radiation pulses, can be compensated by appropriate time control of the sample and hold circuit. It can thus be ensured that the analog output signal of the amplifier circuit is digitized at a point in time when the level of the output signal has not yet reached its maximum or when the level of the output signal has already dropped again. Digitizing the output signal at a point in time when it is at least approximately at maximum level can significantly help to provide smoke detection that is both reliable and less prone to false alarms.

It should be noted that the duration of the radiation pulse or pulses emitted by the radiation source can be adapted e.g. as part of calibrating the smoke detection device described. During such a calibration, alignment of the optical and/or electronic signal path within the smoke detector is usually performed. In this process, a defined scattering body is introduced into a measuring chamber of the smoke detector and the digitized output signal of the analog-to-digital converter is obtained.

The optical and/or electronic signal path includes, for example, the control of the radiation source by the control device, the efficiency of the radiation source, the optical scattering conditions inside the measuring chamber, the efficiency of the radiation detector, the gain of the amplifier circuit and the signal conversion of the analog-to-digital converter. If during calibration of a particular smoke detector the digitized output signal of the analog-to-digital converter were to be smaller than intended e.g. as the result of a relatively weak radiation source, this can be inventively compensated by lengthening the pulse duration of the radiation pulses. If e.g. because of a relatively powerful radiation source the output signal of the analog-to-digital converter were to be larger than intended, this can be compensated by shortening the pulse duration of the radiation pulses.

It should also be noted that the position in time of the scanning timepoint of the sample and hold circuit can self-evidently also be adapted relative to a control pulse for the radiation source, i.e. control pulses for the radiation source are time-correlated with the actual radiation pulses. The advantage of this is that complete synchronization between control pulse and scanning timepoint can be carried out in the control device of the smoke detector.

The control device can determine the scanning timepoint dependent on the respective radiation pulse by means of a function stored in the control device or by means of a table stored in the control device.

The radiation source can be controlled by the control device with or without feedback. In the case of a feedback arrangement, the control device could also be termed a closed-loop controller of the radiation source and/or of the behavior of the sample and hold circuit. In this application, the term "control" can mean both open-loop control and closed-loop control.

In the context of this application, the term "radiation" is used for any kind of electromagnetic radiation. Said electromagnetic radiation can be a discrete or a continuous spectrum having any wavelengths. The radiation can contain, for example, visible, infrared or ultraviolet light. Even X-ray radiation or microwave radiation can be used for scatter measurements within the scope of the present invention.

According to an exemplary embodiment of the invention, the amplifier circuit is a circuit made up of discrete components. Said discrete components are in particular bipolar passive components such as resistors and capacitors or active components such as simple transistors. This means that no integrated devices such as operational amplifiers or special ASIC (Application Specific Integrated Circuit) devices are used for the amplifier circuit described.

The advantage of not using integrated components is that the amplifier circuit described and therefore the smoke detector as a whole can be manufactured particularly inexpensively. As a result of the above described matching of the scanning timepoint to the pulse duration of the radiation pulses or rather to the pulse duration of the control pulses for the radiation source, unwanted artifacts which are more likely to occur in a discrete amplifier circuit than in an op-amp based amplifier circuit, can be at least largely compensated.

In addition to reducing the costs, using a discrete amplifier circuit offers the possibility of reducing the power consumption of the smoke detector as a whole. This is particularly advantageous in the case of a battery operated smoke detector.

According to another exemplary embodiment of the invention, the smoke detection device additionally has a temperature sensor linked to the control device. Said control device is also designed to control the radiation source and the sample and hold circuit such that the position in time of a scanning timepoint of the sample and hold circuit relative to a radiation pulse additionally depends on a temperature detected by the temperature sensor. The advantage of this is that, e.g. by selectively time shifting the scanning timepoints initiated by the control device, it can be ensured that even after a temperature change the analog output signals of the amplifier circuit are always sampled at least approximately when the output signal has a comparatively high level. Temperature artifacts can thus be advantageously eliminated or at least greatly reduced.

According to another exemplary embodiment of the invention, the temperature sensor is a temperature sensor incorporated in the control device. The advantage of this is that it is not necessary to mount a separate temperature sensor in or on the smoke detector and provide appropriate wiring. As modern microprocessors are equipped with a temperature sensor anyway, using a temperature sensor incorporated in the control device is also advantageous for economic reasons.

According to another exemplary embodiment of the invention, the analog-to-digital converter and the control device are implemented by means a common integrated component. The common integrated component can be, for example, a simple microprocessor which is less expensive that a separate control device and a separate analog-to-digital converter.

According to another exemplary embodiment of the invention, the amplifier circuit has an integrator.

The advantage of using an integrator is that the output signal of the radiation detector can be amplified in a simple manner. Said integrator can be regarded as one and preferably the first stage of a multistage amplifier circuit.

The integrator can preferably be implemented by a known RC circuit, the output signal of the radiation detector being integrated in known manner by charge accumulation across the capacitor. Obviously, both the capacitance of the capacitor and the resistance of the ohmic resistor must be matched to the relevant conditions in respect of the required time constant.

According to another exemplary embodiment of the invention, the sample and hold circuit is a track & hold circuit.

In contrast to a sample & hold circuit, which is used in most analog-to-digital converters, with a track & hold circuit the entire network of the analog-to-digital converter is switched in for a longer period. This applies to the entire or at least a comparatively long time segment in which the analog output signal of the amplifier circuit is increasing.

The track & hold circuit can be switched in, for example, immediately after the start of the rise of the output signal of the amplifier circuit and switched out again or released when the signal reaches its maximum. This means that not only the maximum but a longer rise of the output signal of the amplifier circuit is used to detect the strength of the output signal.

The track & hold circuit can have a capacitor which is charged in known manner by the output signal of the amplifier circuit. The charge accumulated across said capacitor is then a direct measure of the strength of the output signal of the amplifier circuit and therefore also of the density of smoke particles present in the measuring chamber.

It should be noted that the load of the analog-to-digital converter network, which is switched in for longer compared to a sample & hold circuit, can already be taken into account when setting the operating point of the amplifier circuit.

Compared to using a conventional sample & hold circuit with a sample & hold capacitor, the advantage of using a track & hold circuit is the absence of so-called sample & hold spikes resulting from the sample & hold capacitor being only briefly switched in.

According to another aspect of the invention, a method for calibrating a smoke detecting device based on scattered electromagnetic radiation measurements is described. The method can be carried out in particular using a smoke detector of the above mentioned type. The calibration method described involves (a) adjusting a pulse duration of a radiation source for emitting illuminating radiation consisting of a time sequence of radiation pulses which, after at least partial scattering of the illuminating radiation, are received as measuring radiation by a radiation detector, and (b) adjusting a scanning timepoint of a sample and hold circuit of an analog-to-digital converter which converts an analog output signal of an amplifier circuit connected downstream of the radiation detector into a digital measured value, relative to the start and/or end of the pulse duration of the radiation source. According to the invention, the position in time of the scanning timepoint of the sample and hold circuit relative to a radiation pulse depends on the duration the radiation pulse.

The calibration method described is also based on the recognition that a time shift of the analog output signal of the amplifier circuit caused by a variation in the pulse duration of the illuminating radiation pulses can be compensated by corresponding time control of the sample and hold circuit. This makes it possible to ensure that the digitization of the output signal takes place at a point in time when it is at least approximately at its maximum level.

According to an exemplary embodiment of the invention, the pulse duration set depends on a reference measured value for the digital measured value, said reference measured value being determined by means of a scattered radiation measurement on a defined scattering medium.

The reference measurement described enables the entire optical and electronic signal path within the smoke detector to be encompassed. Tolerance fluctuations of the corresponding components of the smoke detector such as radiation source control, radiation source, measuring chamber, radiation detector, amplifier circuit and analog-to-digital converter (incl. sample and hold circuit) can therefore be compensated by appropriately adapting the pulse duration of the radiation source. Thus, for example, in the case of a weak radiation source, a comparatively ineffective radiation detector and/or a comparatively weak amplifier, the duration of the radiation pulses is increased in order to obtain nevertheless a reliable scattered radiation signal.

It should be noted that embodiments of the invention have been described with reference to different subject matters of the invention. In particular, a number of embodiments of the invention are described using device claims and other embodiments of the invention using method claims. However, it will become immediately clear to the average person skilled in the art when reading this application that, unless explicitly stated otherwise, in addition to a combination of features belonging to one type of subject matter of the invention, any combination of features belonging to different types of subject matter of the invention is also possible.

Further advantages and features of the present invention will emerge from the following description of currently preferred exemplary embodiments. The individual figures in the accompanying drawings of this application should only be regarded as schematic and not to scale.

DESCRIPTION OF THE INVENTION

Figure 1:
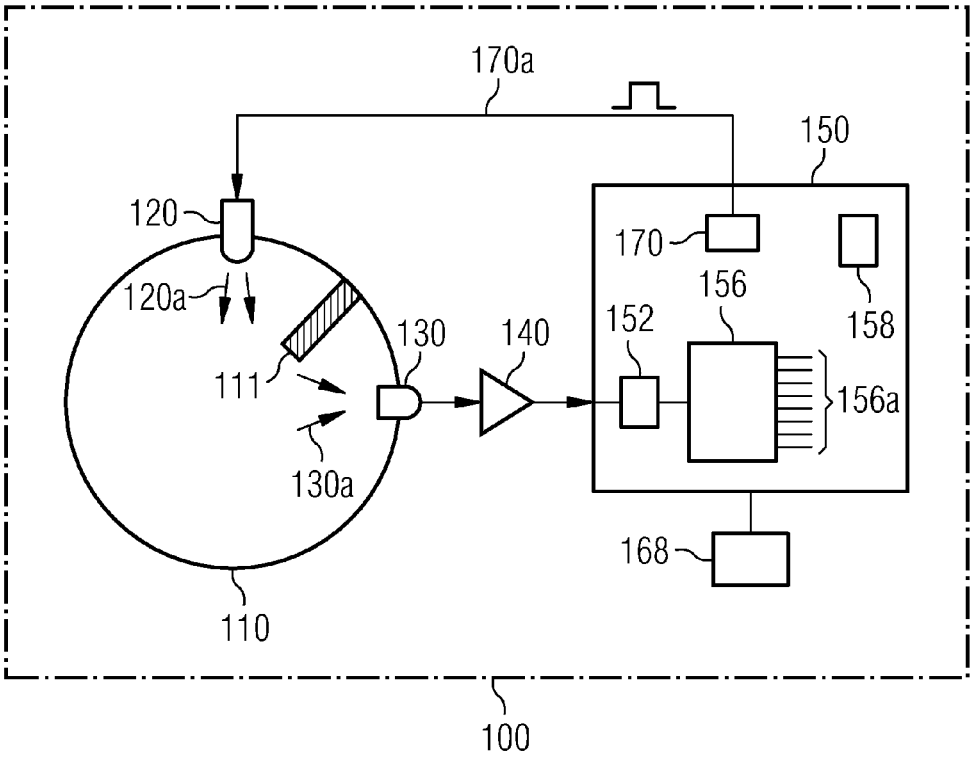
FIG. 1 shows a smoke detector based on the optical scattered light principle according to an exemplary embodiment of the invention.

It should be noted at this juncture that, in the drawings, the reference characters of identical or mutually corresponding components differ from one another only in their first digit.

It is further pointed out that the embodiments described below only represent a limited selection of possible variants of the invention. In particular, it is possible to combine the features of individual embodiments in a suitable manner, so that, for the average person skilled in the art, using the variants explicitly set out here, a large number of different embodiments must be regarded as self-evidently disclosed.

The following description relates to a smoke detector which detects the presence of smoke by means of the occurrence of scattering of light by smoke particles. Said light can be infrared, visible or ultraviolet light. As already stated above, instead of light, any kind of electromagnetic radiation of any wavelength can be used for detecting smoke.

FIG. 1 shows smoke detector 100 based on the optical scattered light principle. The smoke detector has measuring a chamber 110 into which smoke penetrates e.g. in the event of a fire. The measuring chamber is also termed the scattering volume 110. The measuring chamber 110 contains a light source 120 implemented as a photodiode to which control pulses are applied via a control line 170*a* which cause it to emit pulsed illuminating light 120*a*. Additionally present in the edge region of the measuring chamber 110 is a light detector 130 implemented as a photodiode which receives measuring light 130*a* which is incident on the light detector 130 after at least partial scattering of the illuminating light 120*a* by smoke particles. An optical barrier 111 prevents the illuminating light 120*a* from being directly incident on the light detector 130.

Connected downstream of the light detector 130 is an amplifier circuit 140 which converts photocurrent produced in the event of light being incident on the light detector 130 into a voltage signal which can be further processed by a control device 150. According to the exemplary embodiment presented here, the amplifier circuit 140 comprises only individual discrete electronic components, as will be described in greater detail below with reference to FIG. 3*b*. Operational amplifiers or ASIC (Application Specific Integrated Circuit) devices are not included in the amplifier circuit 140 for cost reasons.

As can be seen from FIG. 1, a sample and hold circuit 152 and an analog-to-digital converter 156 are also incorporated in the control device 150. These two components are used to convert an analog output signal of the amplifier circuit 140 into a digital measured value 156*a* which can undergo further processing (not shown) and can initiate a fire alarm indication e.g. if a certain limit value is exceeded.

According to the exemplary embodiment shown here, the sample and hold circuit is operated as a track & hold circuit 152. As already stated above in the general description of the invention, with a track & hold circuit the entire network of the analog-to-digital converter remains switched in for a longer period. According to the exemplary embodiment presented here, the track & hold circuit is switched in immediately the output signal of the amplifier circuit 140 begins to rise and is switched out again when the maximum level of the output signal of the amplifier circuit 140 is reached. In this way, not only the signal maximum but a longer rise of the output signal of the amplifier circuit is used to detect the strength of the output signal.

The control device 150 also has a driver circuit 170 for the light source 120 which is connected to the control device 150 or more specifically to the driver circuit 170 via a control line 170*a*. The driver circuit 170 will be explained in greater detail below with reference to FIG. 3*a*.

As can be seen from FIG. 1, the control device 150 also has an internal temperature measuring diode 158 with which the temperature of the control device 150 and possibly also the temperature of the smoke detector 100 as a whole can be measured. Alternatively or in combination, the temperature can also be measured using an external temperature sensor 168. The external temperature sensor 168 can be e.g. an NTC thermistor.

In order to ensure proper operation of the smoke detector 100, calibration is performed prior to putting it into service. In this process, a defined scattering body (not shown in FIG. 1) is introduced into the measuring chamber 110 and the digitized output signal 156*a* of the analog-to-digital converter 156 is measured and compared with a predetermined response value. By using a defined scattering body, the entire optical and electronic signal path within the smoke detector is automatically encompassed.

Figure 2:
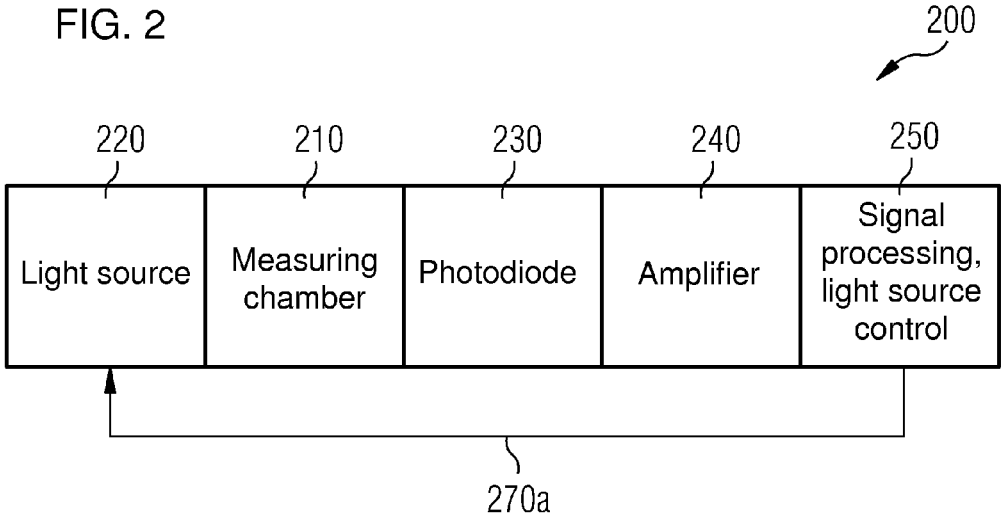
FIG. 2 shows a schematic representation of the entire optical and electronic signal path within the optical smoke detector illustrated in FIG. 1.

FIG. 2 schematically illustrates the entire optical and electronic signal path within the optical smoke detector 100, which is now provided with the reference character 200. This signal path comprises in particular the triggering of the light source 220 by the control device 250, the efficiency of the light source 220, the optical scattering conditions inside the measuring chamber 210, the efficiency of the light detector 230, the gain of the amplifier circuit 240 and the signal conversion of the analog-to-digital converter within the control device 250.

If the comparison shows that the digitized output signal of the analog-to-digital converter is smaller than intended, e.g. as the result of a relatively weak light source 220, this is compensated by corresponding lengthening of the pulse duration of the light pulses. If the output signal of the analog-to-digital converter is larger than intended, e.g. as the result of a particularly powerful light source 220, this is compensated by shortening the pulse duration of the light pulses.

This means that, in contrast to known optical smoke detectors, the smoke detector 100 described is calibrated not by adjusting the gain of the amplifier circuit 240 but by adjusting the pulse durations of the illuminating pulses emitted by the light source 220.

In order to keep the ON-time of the light source 220 within predetermined limits, the light source 220 can come from a preselection of different light sources with defined light outputs, possibly of differing luminous efficiencies.

Figure 3A:
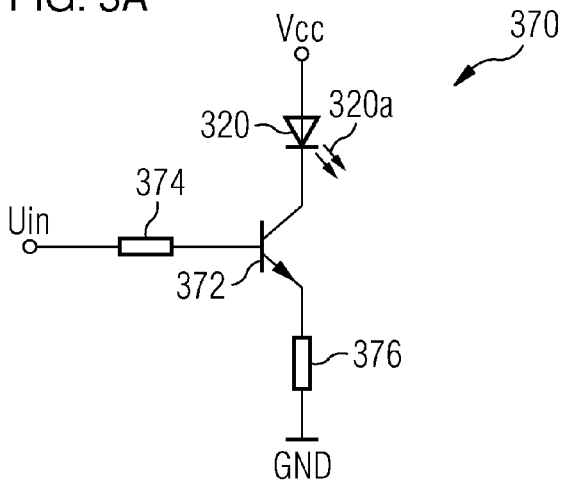
FIG. 3*a* shows a driver circuit for a light source of the optical smoke detector illustrated in FIG. 1.

FIG. 3*a* shows a driver circuit 370 for the light source 120 of the optical smoke detector 100 shown in FIG. 1. The light source is now provided with the reference character 320.

The driver circuit 370 has a transistor 372 whose collector is connected to a supply voltage Vcc via the light source 320 which emits illuminating light 320*a* when an appropriate current flows. The base of the transistor 372 is connected to an input control signal Uin via an ohmic resistor 374. The collector of the transistor 372 is connected to ground GND via an ohmic resistor 374.

At an appropriate level of the input control signal Uin, the transistor 372 is turned on and current flows through the light source 320 implemented as a light emitting diode. The amount of current flowing through the light emitting diode 320 depends in known manner on the supply voltage Vcc and on the resistance 376.

Figure 3B:
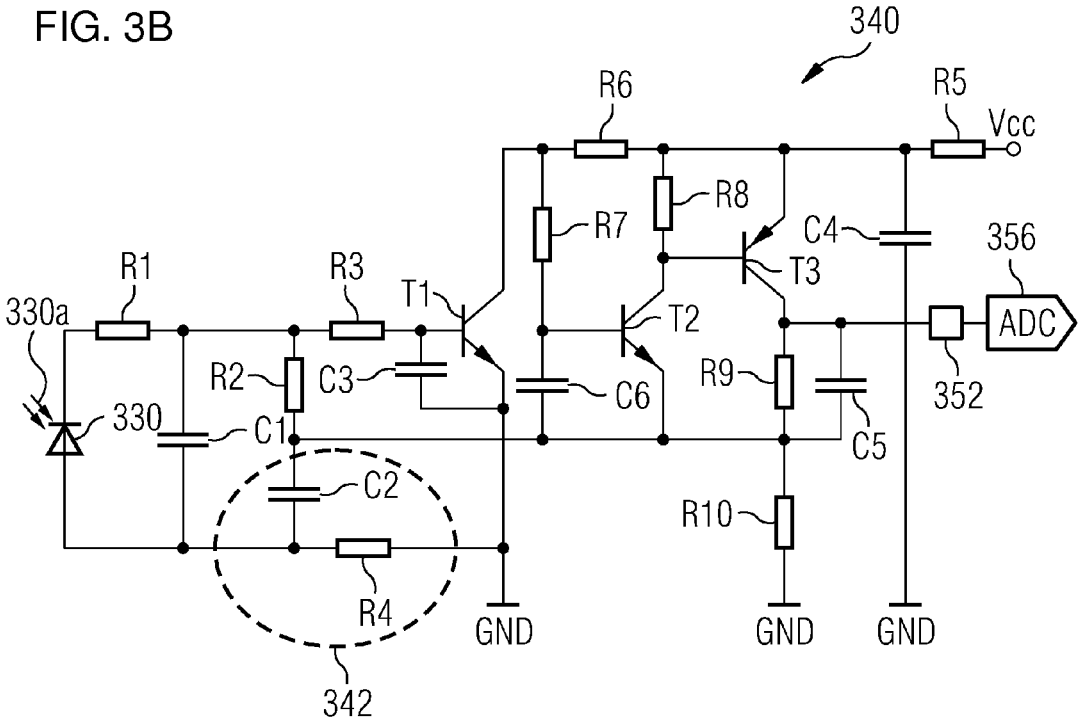
FIG. 3*b* shows an amplifier circuit of the optical smoke detector illustrated in FIG. 1, said amplifier circuit containing only discrete components.

FIG. 3*b* shows an amplifier circuit 340 having only discrete components, as is used according to the exemplary embodiment shown here for the amplifier circuit 140 of the optical smoke detector 100 illustrated in FIG. 1. The discrete amplifier circuit 340 has a transimpedance R1 by means of which a flow of current through the photodiode 330 is converted into a primary voltage signal. A capacitor C1 is used to smooth the voltage signal. The capacitor C2 together with the resistor R4 constitutes a current-time integrator 342 which can be regarded as a first amplifier stage. The regions of the amplifier circuit 340 around the transistors T1, T2 and T3 can be regarded as a second amplifier stage, with T2 and T3 constituting a controlled current source.

As can be seen from FIG. 3*b*, the entire amplifier circuit 340 is fed by the supply voltage Vcc. Located at the output of the amplifier circuit 340 is a sample and hold circuit (denoted by reference character 352) which together with a downstream analog-to-digital converter 356 ensures reliable conversion of the analog output signal of the amplifier circuit 340 into a digital measurement signal.

The amplifier circuit 340 shown as well as the output thereof is designed for very low power consumption of around 3 to 5 μA. For this reason, the amplifier circuit 340 and also its output are unable to speedily compensate electrical load variations at the output. However, such load changes may be produced by the switching-in of a typical sample & hold input stage (with a low resistance connected capacitor) for the analog-to-digital converter 356. The to-be-measured analog output signal of the amplifier circuit 340 would therefore be heavily detuned briefly by at least one spike. Obviously the amplifier circuit 340 could also be designed with lower resistance, but this would again increase the power consumption of the amplifier circuit 340.

In order to overcome this disadvantage and nevertheless prevent detuning of the analog output signal of the amplifier circuit 340 in the case of low power consumption, according to the exemplary embodiment described here the sample and hold circuit is operated as a track & hold circuit 352.

Figure 3C:
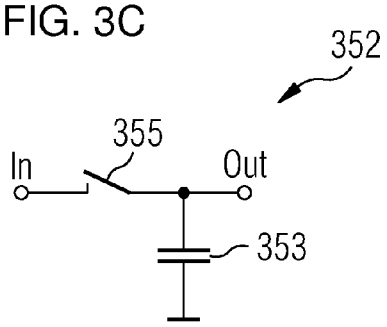
FIG. 3*c* shows a sample and hold circuit which is incorporated in the control device of the optical smoke detector illustrated in FIG. 1.

FIG. 3*c* shows the sample and hold circuit 352 operated as a track & hold circuit which is incorporated in the control device of the optical smoke detector 100 shown in FIG. 1.

The central element of the track & hold circuit 352 is a capacitor 353 which assumes a storage function for the analog values present at an input IN of the track & hold circuit 352. To this is added an electronic switch 355 which determines the sample and hold phase. At an output OUT, the track & hold circuit 352 provides the signal for digitization by the analog-to-digital converter 356.

If the switch 355 is closed, the capacitor 353 is charged. In order to be able to charge the capacitor 355 quickly, the capacitor 353 can have a small capacitance. However, the disadvantage of a capacitor 353 with low capacitance is that it also discharges rapidly and, as a result, is unable to keep the amplifier circuit 340 for as long at the required level.

When the switch 355 is open, it has a high off-state resistance and the isolation of the capacitor 353 is very good, thereby enabling undesirable self-discharging of the capacitor 353 to be counteracted.

The charge accumulated across the capacitor 353 is a direct measure of the strength of the output signal of the amplifier circuit 340 and therefore also of the density of smoke particles present in the measuring chamber 110.

Unlike a sample & hold circuit in which the switch 355 is only closed for a comparatively short time span and, due to the brief closing of the switch 355, undesirable spikes or more specifically brief detunings of the analog signal to be measured occur, with the track & hold circuit 352 the entire network of the analog-to-digital converter 356 is switched in for a comparatively long period. This applies, for example, to the entire or at least for a comparatively long time segment in which the analog output signal of the amplifier circuit 340 is increasing.

The track & hold circuit 352 can be switched in, for example, immediately the output signal of the amplifier circuit 340 begins to rise due to closing of the switch 355 and is switched out or disconnected again when the signal reaches its maximum. Thus not only the signal maximum but a longer rise of the output signal of the amplifier circuit 340 is advantageously used for charging the capacitor 353 and therefore for measuring the strength of the output signal. Undesirable spikes which usually occur, as described above, with a sample & hold circuit do not occur with the track & hold circuit 352.

It should be noted that the load of the analog-to-digital converter 356 which in the case of the track & hold circuit 352 described is connected longer than with the sample & hold circuit, can already be taken into account when setting the operating point of the amplifier circuit 340.

Figure 4:
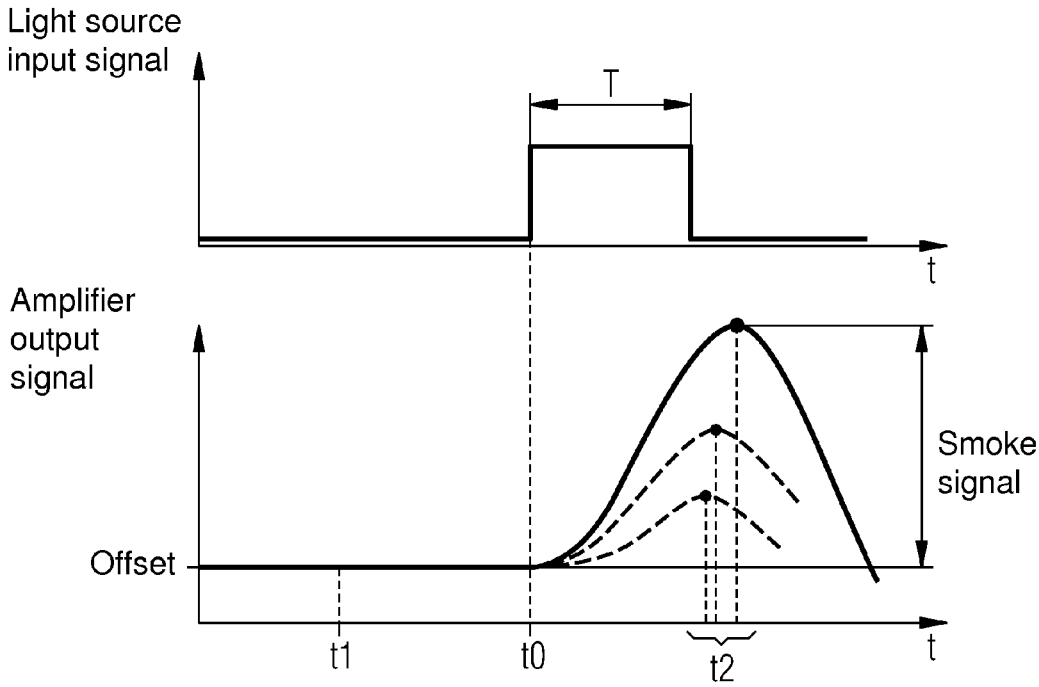
FIG. 4 shows, for the optical smoke detector illustrated in FIG. 1, a comparison of the timing between the triggering of the light source and the output signal of the amplifier circuit.

For the optical smoke detector 100 shown in FIG. 1, FIG. 4 shows a comparison of the timing between the triggering of the light source (top) and the output signal of the amplifier circuit 140, 340 (bottom).

As already explained above, the optical and electronic signal path within the smoke detector 100 is inventively calibrated by suitable adjustment of the time duration T of the trigger pulses. As the illuminating pulses follow at least approximately the pattern of the trigger pulses, by varying the time duration T, the duration of the illuminating light pulses can therefore also be varied.

In the lower diagram of FIG. 4, the waveforms of three different output signals are plotted resulting from different time durations T for a trigger pulse for the light source. The continuous line 491 represents the output signal of the amplifier circuit in the case of a comparatively long pulse duration T. The dashed line 492 represents the output signal of the amplifier circuit in the case of a medium pulse duration T. The dashed line 493 represents the output signal of the amplifier circuit in the case of a comparatively short pulse duration T.

As can be seen from FIG. 4, the maximum of the respective output signal is shifted back in time with increasing length of the trigger pulse T. This shift is inventively compensated by correspondingly shifting back the so-called hold instant at which the actual analog to digital conversion takes place, relative to the timepoint t0 at which the trigger pulse exhibits its rising edge. This adjustment of the hold timepoint is performed by the control device 150 shown in FIG. 1.

As can also be seen from FIG. 4, according to the exemplary embodiment shown here the smoke signal of the smoke detector is determined by taking the difference between the maximum of the output signal of the amplifier circuit at a timepoint t2 and an offset value of the output signal of the amplifier circuit at a timepoint t1. Said timepoint t1 is preferably selected such that the corresponding measurement of the offset value, which is likewise performed by means of the track & hold circuit and by means of the downstream analog-to-digital converter, is in no way falsified by the scattered light measurement.

It should be noted that the temperature of the entire smoke detector 100 and in particular the temperature of the amplifier circuit 140 and/or of the control device 150 may also contribute to a time shift of the maximum of the output signal of the amplifier circuit. By measuring the corresponding temperature with the internal temperature measuring diode 158 and/or with the external temperature sensor 168, this temperature effect can also be compensated by suitable adjustment of the hold timepoint and therefore contribute to reliable smoke detection.

LIST OF REFERENCE CHARACTERS

100 smoke detector
110 measuring chamber/scattering volume
111 barrier
120 radiation source/light source/LED
120*a* illuminating radiation/illuminating light
130 radiation detector/light detector/photodiode
130*a* measuring radiation/measuring light
140 amplifier circuit
150 control device
152 sample and hold circuit/track & hold circuit
156 analog-to-digital converter
156*a* measured value
158 internal temperature measuring diode
168 external temperature sensor/NTC
170 driver circuit
170*a* control line
200 smoke detector
210 measuring chamber/scattering volume
220 radiation source/light source/LED
230 radiation detector/light detector/photodiode
240 amplifier circuit
250 control device
270*a* control line
320 radiation source/light source/LED
320*a* illuminating radiation/illuminating light
330 radiation detector/light detector/photodiode
330*a* measuring radiation/measuring light
340 amplifier circuit
342 integrator
352 sample and hold circuit/track & hold circuit
353 storage capacitor
355 switch
356 analog-to-digital converter
370 driver circuit
372 transistor
374 resistor
376 resistor
Vcc supply voltage
GND ground
R resistor
T1-T3 transistor
C1-C6 capacitor
R1-R10 resistor
IN input
OUT output
Uin input control signal
491 output signal of amplifier circuit for long pulse duration T
492 output signal of amplifier circuit for medium pulse duration T
493 output signal of amplifier circuit for short pulse duration T
T time duration of trigger pulses for LED

The invention claimed is:

1. A device for detecting smoke on a basis of measurements of electromagnetic radiation, the device comprising:

a radiation source for emitting illuminating radiation having a time sequence of radiation pulses;

a radiation detector for receiving measuring radiation which is incident on said radiation detector after at least partial scattering of the illuminating radiation;

an amplifier circuit for amplifying an output signal of said radiation detector;

an analog-to-digital converter with a sample and hold circuit for converting an analog output signal of said amplifier circuit into a digital measured value; and a control device linked to said radiation source and said sample and hold circuit and set up to control said radiation source and said sample and hold circuit such that a position in time of a scanning time point of said sample and hold circuit relative to a radiation pulse depends on a time duration of the radiation pulse.

2. The device according to claim 1, wherein said amplifier circuit is a circuit made up of discrete components.

3. The device according to claim 1, further comprising a temperature sensor linked to said control device, said control device also being set up to control said radiation source and said sample and hold circuit such that the position in time of the scanning time point of said sample and hold circuit relative to the radiation pulse additionally depends on a temperature measured by said temperature sensor.

4. The device according to claim 3, wherein said temperature sensor is a temperature sensor incorporated in said control device.

5. The device according to claim 1, wherein said analog-to-digital converter and said control device are a common integrated component.

6. The device according to claim 1, wherein said amplifier circuit has an integrator.

7. The device according to claim 1, wherein said sample and hold circuit is a track & hold circuit.

8. A method for calibrating a device for detecting smoke on a basis of measurements of scattered electromagnetic radiation, which comprises the steps of:

setting a pulse duration of a radiation source for transmitting illuminating radiation having a time sequence of radiation pulses which, after at least partial scattering of the illuminating radiation are received as measuring radiation by a radiation detector; and setting a scanning time point of a sample and hold circuit of an analog-to-digital converter which converts an analog output signal of an amplifier circuit connected downstream of the radiation detector into a digital measured value, relative to a start and/or an end of the pulse duration of the radiation source, a position in time of the scanning time point of the sample and hold circuit relative to a radiation pulse depending on a time duration of the radiation pulse.

9. The method according to claim 8, wherein a pulse duration setting depends on a reference measured value for the digital measured value, the reference measured value being determined by means of a scattered radiation measurement on a defined scattering medium.

* * * * *